US006026603A

United States Patent [19]

Kump et al.

[11] Patent Number: 6,026,603

[45] Date of Patent: Feb. 22, 2000

[54] LABEL HOLDER WITH REARWARD EXTENDING DUST FLANGE

[75] Inventors: Daniel J. Kump, Gates Mills; Paul A. Mueller, Wadsworth, both of Ohio

[73] Assignee: Fasteners For Retail, Inc., Cleveland, Ohio

[21] Appl. No.: 08/896,033

[22] Filed: Jul. 17, 1997

[51] Int. Cl.[7] ..... G09F 3/18

[52] U.S. Cl. ..... 40/661.03; 40/661.07; 40/661.08

[58] Field of Search ..... 40/5, 642.02, 644, 40/661.03, 661.07, 661.08, 649, 650; 211/94.01; 248/225.11, 223.41

[56] References Cited

U.S. PATENT DOCUMENTS

| | | | |
|---|---|---|---|
| 3,320,690 | 5/1967 | Forsburg | 40/650 |
| 4,557,064 | 12/1985 | Thompson | 40/661.03 |
| 5,044,104 | 9/1991 | Hopperdietzel . | |
| 5,197,215 | 3/1993 | Torsleff | 40/649 X |
| 5,263,269 | 11/1993 | Tjärnlund | 40/5 |
| 5,392,547 | 2/1995 | Mason | 40/5 X |
| 5,394,632 | 3/1995 | Gebka et al. | 40/661.03 |
| 5,456,034 | 10/1995 | Lewis et al. | 40/666 |
| 5,488,793 | 2/1996 | Gebka et al. | 40/661.03 |

FOREIGN PATENT DOCUMENTS

| | | |
|---|---|---|
| 0 511 468 A1 | 2/1992 | European Pat. Off. . |
| 3900904 C1 | 1/1989 | Germany . |
| WO 91/05324 | 4/1991 | WIPO . |
| WO 93/10516 | 5/1993 | WIPO . |

OTHER PUBLICATIONS

Fasteners For Retail, 1997 Buyers Guide.

afi, Scanning Profiles brochure, August Fischer GmbH, Apr., 1991.

Fit–All–Pricing Corporation brochure, pre–1993.

Bentler GmbH brochure, pre–1995.

Cover page and p. 3 of Southern Imperial, Inc. "JFK Labelholder Catalog" Form: JKC–010596–B; Effective Date Mar. 19, 1996).

Cover page and p. 157 of Southern Imperial, Inc. brochure entitled "The Complete Reference Guide" (circa 1997).

*Primary Examiner*—Joanne Silbermann

*Attorney, Agent, or Firm*—Fay, Sharpe, Fagan, Minnich & McKee, LLP

[57] ABSTRACT

A label holder including a mounting portion for engaging with a merchandising shelf and a display portion joined to the mounting portion is disclosed. The display portion includes an rear label panel and a second label panel in registry with said first label panel. Mutual lower edges of the rear and front label panels are joined together to form a bottom wall. An upper edge of the front label panel extends beyond an upper edge of the rear label panel. A dust flange extends transversely from the upper edge of the front label panel in a direction toward the mounting portion over the rear label panel. When the label holder is mounted to the merchandising shelf, the dust flange prevents dust and other particles from settling in a label pocket defined between the rear and front label panels. The dust flange also prevents dust and particles from settling on an upper end surface of a label positioned within the label pocket. In addition, the dust flange, by virtue of being positioned above the upper edge of the rear label panel, permits a user to easily pivot the front label panel away from the rear label panel to insert, reposition, modify, or replace a merchandising label from within the label pocket. Further, the dust flange may be used to secure a display card holder to the front label panel.

18 Claims, 4 Drawing Sheets

LABEL HOLDER WITH REARWARD EXTENDING DUST FLANGE

BACKGROUND OF THE INVENTION

This invention relates to a label holder. More particularly, the invention relates to a label holder with a rearward extending flange for preventing dust and other contaminants from settling in a label pocket defined between rear and front label panels associated with the label holder.

Merchandising displays typically include a support surface for permitting label holders to be secured thereto. Known label holder support surfaces include a C-channel, a wire bar or rod, a planar surface for receiving an adhesively-backed label holder, etc. Label holders typically include a mounting portion for engaging with the label holder support mechanism, and a display portion for supporting a merchandising label. Known label holder display portions include a rear label panel, and an adjacent front label panel having end edges which are registered with mutual end edges of the rear label panel. The front and rear label panels cooperate to define an upwardly opening label pocket therebetween when the front and read label panels are urges away from each other. A merchandising label may then be placed into, repositioned, modified, or removed from the label pocket.

The front label panel typically remains slightly spaced apart from the rear label panel when a merchandising label is inserted into the label pocket. Over a period of time, dust and other contaminants can enter the upward opening label pocket, and settle on the upper edge of the merchandising label held in the label pocket. It is extremely difficult, time consuming, and labor intensive to remove dust and contaminants which build-up within the label pocket. For instance, it is difficult to sufficiently separate the two label panels from each other in order to throughly clean the label pocket. In addition, the front label panel is usually formed from a clear thermoplastic material which is susceptible to marring and scratches that develop when attempts to remove the dust and other contaminants are performed.

Further, it is somewhat difficult to separate the front and rear label panels from each other when it is desired to clean the label pocket, or to insert, reposition, modify, or replace a merchandising label within the label pocket. That is, the front and rear label panels are typically formed as thin, mutually registered panels which abut and do not provide a convenient location for a finger hold.

Accordingly, it has been considered desirable to develop a new and improved label holder which would overcome the foregoing difficulties and others while providing better and more advantageous overall results.

BRIEF SUMMARY OF THE INVENTION

In accordance with one aspect of the present invention, a new and improved label holder is provided for use on a merchandise display element. More particularly, in accordance with this aspect of the invention, the label holder includes a mounting portion and a display portion joined to the mounting portion. The display portion includes an rear label panel and an front label panel. The front label panel has a first edge and a second edge. The front label panel is joined to the rear label panel along the first edge. A dust flange extends from the second edge in a direction toward the mounting portion. The dust flange extends over the rear label panel.

In accordance with another aspect of the present invention, a label holder is provided. More particularly, the label holder includes a mounting portion and a display portion connected to the mounting portion. The display portion includes a first label panel having a first end edge and an opposing second end edge. The display portion also includes a second label panel in registry with the first label panel and having a third end edge and an opposing fourth end edge, as well as a hinge at which the first and third end edges are joined together. The fourth end edge extends past the second end edge. A dust flange extends from the fourth end edge over the second end edge in a direction toward the mounting portion.

In accordance with another aspect of the present invention, a merchandising system is provided. The merchandising system includes a label holder comprising a mounting portion and a display portion connected to the mounting portion. The display portion includes a rear panel having a lower edge and an upper edge and a front panel having a lower edge and an upper edge with the rear panel lower edge being connected to the front panel lower edge. A dust flange is connected to the front panel upper edge and extends toward the mounting portion. The dust flange projects above the rear panel upper edge. A display card holder is selectively mounted on the dust flange. The display card holder includes front and rear walls and fins mounted on at least one of the front and rear walls and extending towards the other of the front and rear walls.

In accordance with still another aspect of the present invention, a merchandising system is provided including a merchandising fixture having a support surface and a label holder having a mounting portion for engaging with the support surface and a display portion joined to the mounting portion. The display portion includes a first label panel having a first edge and a second edge and a second label panel having a first edge and a second edge. The second label panel first edge being joined to the first label panel first edge. A dust flange extends from the second label panel second edge over the first label panel second edge and toward the mounting portion.

One advantage of the present invention is the provision of a label holder which prevents dust and contaminants from settling in a label pocket thereof.

Another advantage of the present invention is the provision of a label holder having a fingerhold which permits an front label panel to be readily separated from a rear label panel for easy insertion and removal of a merchandising label.

Still another advantage of the present invention is the provision of a label holder with a mounting structure for receiving a display card holder.

Yet another advantage of the present invention is the provision of a label holder having a front panel connected to a rear panel by a resilient hinge.

A further advantage of the present invention is the provision of a label holder having a rear panel which is shorter than a front panel thereof.

A still further advantage of the present invention is the provision of a label holder having a front panel, a rear panel, and a dust flange which extends from the front panel rearwardly over the rear panel.

A yet further advantage of the present invention is the provision of a label holder having a display portion and a mounting portion. The display portion includes a pair of parallel panels. The mounting portion can include an adhesive strip or one or more walls or panels by which the label holder can be secured to a conventional merchandising fixture.

An additional advantage of the present invention is the provision of a merchandising system including a label holder and a display card holder that can be selectively mounted to the label holder.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments of the present invention and are not to be construed as limiting same.

DETAILED DESCRIPTION OF THE PREFERRED EMBODIMENTS

Figure 1:
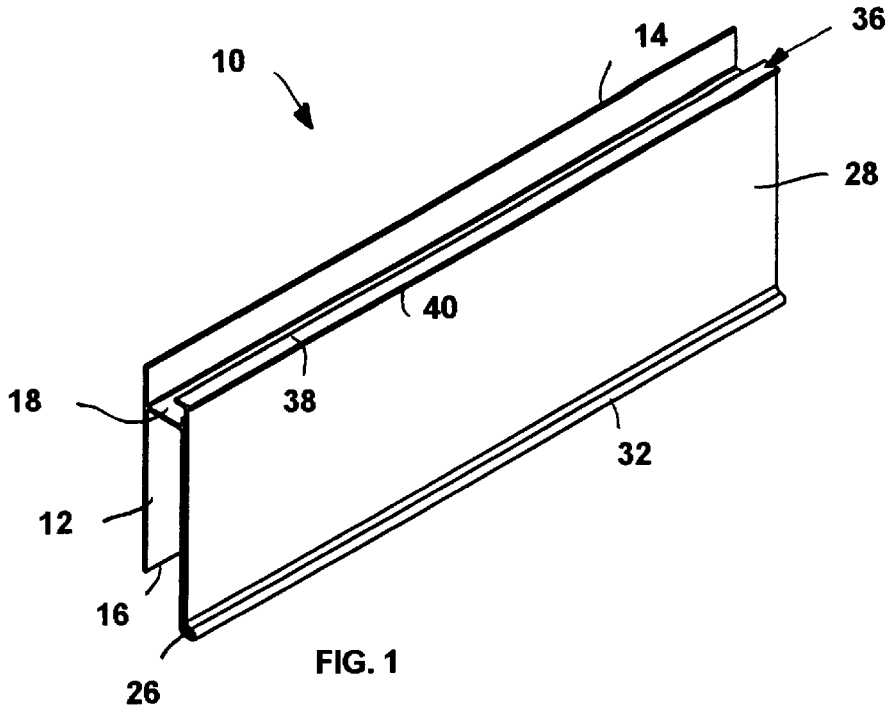
FIG. 1 is a perspective view of a first embodiment of a label holder which incorporates the features of the present invention therein.
Figure 2:
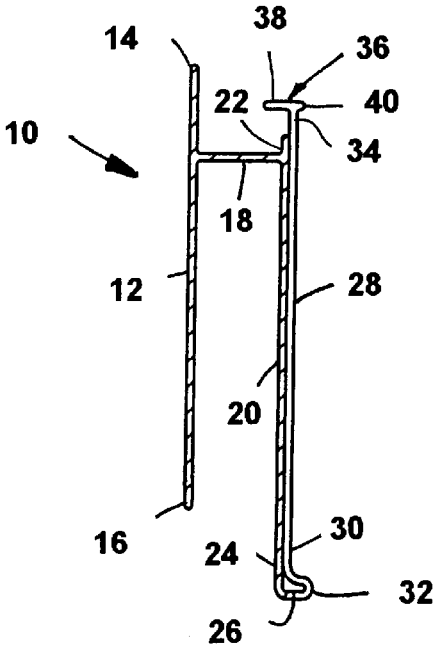
FIG. 2 is an enlarged side elevational view of the label holder of FIG. 1.

Referring now to the drawings, wherein the showings are for purposes of illustrating several embodiments of the invention only and not for the purposes of limiting same, FIGS. 1 and 2 show the label holder 10 according to the first preferred embodiment of the present invention. The label holder 10 comprises mounting portion including a vertical wall 12 having upper and lower end edges 14 and 16, respectively. A horizontal connecting wall 18 extends transversely from the vertical wall 12 near the upper end edge 14 to a display portion of the label holder. The display portion comprises a cantilevered rear label panel 20 which extends transversely from the horizontal wall 18 so as to be substantially parallel to and spaced from the vertical wall 12. An upper end edge 22 of the rear label panel 20 extends above the horizontal wall 18 yet preferably terminates below the upper end edge 14 of the vertical wall 12. However, the upper end edge 22 of the rear label panel 20 may extend above the upper end edge 14 of the vertical wall 12 when desired. A lower end edge 24 of the rear label panel 20 is joined to a bottom wall 26 which extends horizontally below the lower end edge 16 of the vertical wall 12. Likewise, the bottom wall 16 can be located above the lower end edge 16 of the vertical wall 12 when desired.

The label holder 10 further comprises a second or front label panel 28 extending parallel to the rear label panel 20. An arcuate lower end edge 30 of the front label panel 28 is joined to the bottom wall 26 and forms a spring-biased hinge 32 which urges the front label panel 28 into contact with the rear label panel 20. An upper end edge 34 of the front label panel 28 extends above the upper end edge 22 of the rear panel 20. The upper end edge 34 of the front label panel can be positioned below the upper end edge 14 of the vertical wall 12. Alternatively, the upper end edge 34 of the front label panel 28 can extend above the upper end edge 14 of the vertical wall 12 when desired. A top wall 36 extends transversely from the upper end edge 34 of the front label panel 28. The top wall 36 forms a dust flange 38 which extends over the rear label panel 20 in a direction toward the mounting portion vertical wall 12. The top wall 36 also forms a heel portion 40 which extends slightly past the front label panel 26. The rear and front label panels 20, 28 cooperate to define a pocket 42 (FIG. 4) when the front label panel 28 is pivoted forwardly away from the rear label panel 20. The pocket 42 is adapted to receive a conventional planar merchandising label (not shown), or the like therein. Thus, in the embodiment being described, the mounting portion, including the vertical wall 12 and the horizontal wall 18, secures the display portion, including the rear and front label panels 20, 28 and top wall 36, to a shelf, or the like.

Preferably the label holder 10 is formed from a suitable conventional resilient material such as a thermoplastic. The vertical wall 12, horizontal wall 18, and rear label panel 20 are preferably formed from an opaque thermoplastic material. The front label panel 28, however, needs to be formed from a clear thermoplastic material so that labels are visible therethrough. The thermoplastic materials are preferably different types of polyvinylchloride (PVC). In the preferred embodiment, the label holder 10 is integrally produced by being extruded in a known co-extrusion process from the different thermoplastic materials. Since the hinge 32 is made from a suitable resilient material, it has a memory and will return to the unstressed position illustrated in FIG. 2 after inserting, repositioning, modifying, or replacing a merchandising label within the label pocket 42. The front label panel 28 may be easily and quickly separated from the rear label panel 20 by placing an object such as a finger between the dust flange 38 and the vertical wall 12, and then urging the dust flange 38 forward to separate the front label panel 28 from the rear label panel 20.

Figure 3:
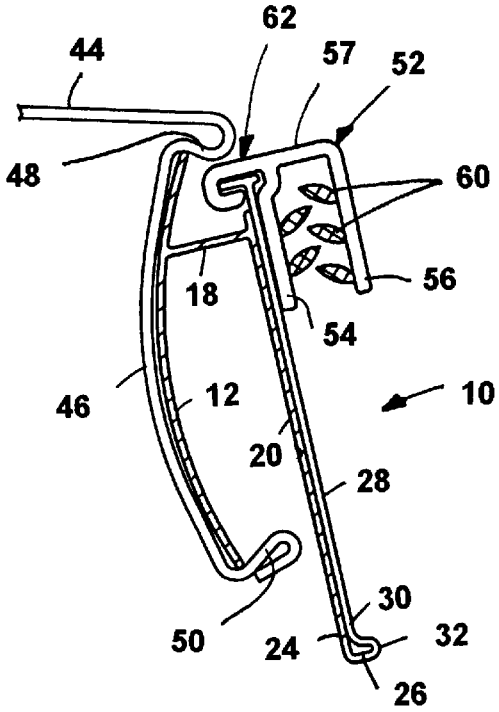
FIG. 3 is a side elevational view of the label holder of FIG. 2 mounted to a shelf, and a display card holder mounted to the label holder.

Referring now to FIG. 3, the label holder 10 may be secured to a conventional shelf 44 which incorporates a front mounted C-channel 46 support member. In particular, the ends 14, 16 of the vertical wall 12 may be flexed toward the display portion of the label holder so as to facilitate inserting the vertical wall 12 between upper and lower transverse end walls 48, 50 of the C-channel 46. When the label holder 10 is mounted to the shelf 44, the dust flange 38 prevents dust and other particles from settling in the pocket 42 and from settling on an upper end surface of a label positioned within the pocket 42. In addition, the dust flange 38, by virtue of being spaced above the upper edge 22 of the rear label panel 20 provides a convenient finger hold which permits a user to easily pivot the front label panel 28 away from the rear label panel 20 to insert, reposition, modify, or replace a merchandising label from within the label pocket 42.

Further, the dust flange 38 may be used to secure an optional display card holder 52 (FIG. 3) to the front label panel 28. The display card holder 52 may include a rear wall 54 and a front wall 56 which extend in a spaced manner from an upper end wall 57 to define a U-shaped cavity 58. A plurality of soft, resilient fingers or fins 60 extend within the cavity 58 from both the rear and front walls 54, 56 so as to retain a display card therein as described further in U.S. Pat. No. 4,557,064 which is assigned to the Assignee of the present invention, and which is incorporated herein by reference.

Figure 4:
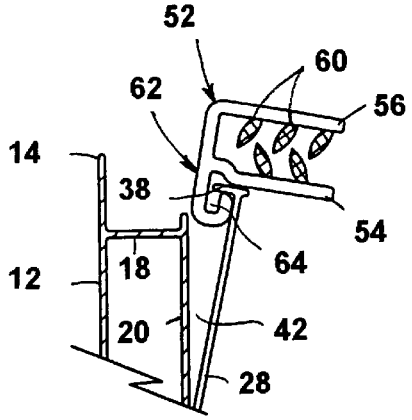
FIG. 4 is a partial side elevational view of the label holder of FIG. 3 with the display card holder initially positioned on a dust flange of the label holder.
Figure 5:
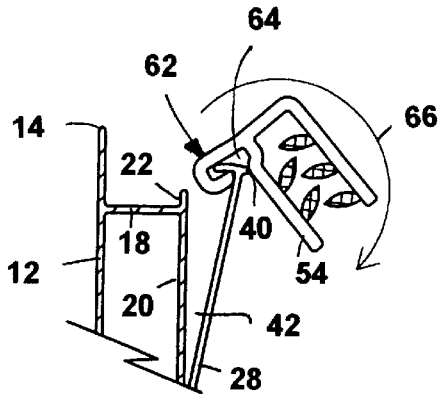
FIG. 5 is a partial side elevational view of the label holder of FIG. 4 showing the display card holder pivoting around the dust flange.
Figure 6:
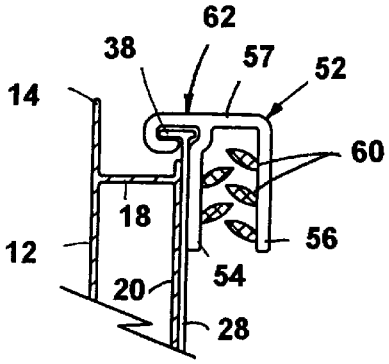
FIG. 6 is a partial side elevational view of the label holder of FIG. 4 with the display card holder in a final display position on the label holder.

A rearwardly projecting, contoured hook portion 62 defines an upper extent of the rear wall 54. The contoured hook portion 62 secures the display card holder 52 to the label holder 10. In particular, as shown in FIG. 4, front label panel 28 is pivoted away from the rear label holder 20 so that a free or rearward end of the dust flange 38 can be positioned within a cavity 64 defined by the hook portion 62. Then, as shown in FIG. 5, the display card holder 52 is pivoted downward in the direction of arrow 66 by urging the rear wall 54 over the heel portion 40 of the horizontal wall 36 and into contact with the front label panel 28. As shown in FIG. 6, the display card holder 52 is fully seated on the label holder 10 when the rear wall 54 is proximate the front label panel 28, and the dust flange 38 and heel portion 40 are positioned within the cavity 64 of the contoured hook portion 62.

Figure 7:
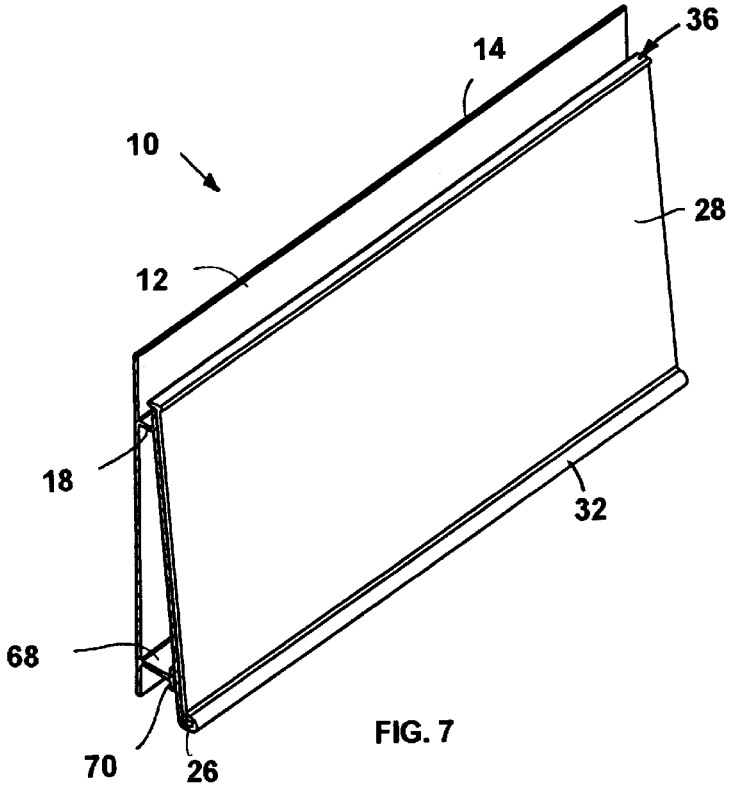
FIG. 7 is a perspective view of a second embodiment of a label holder which incorporates the features of the present invention therein.

As the size of the label holder, and in particular the height of the rear and front label panels is scaled upward, additional support for the rear and front label panels may be required. In this embodiment like components are identified by like numerals with a primed (') suffix and new components are identified by new numerals. Thus, as shown in FIG. 7, a label holder 10' may also include a lower horizontal wall 68 extending transversely from a vertical wall 12' near a lower end edge 16'. A free end of the lower horizontal wall 68 could be joined to a rear label panel 20'. Preferably, however, a vertically extending stop or stand 70 extends transversely from the free end of the lower horizontal wall 68 against which the rear label panel 20' rests. The lower horizontal wall 68 could alternatively extend rearward from the inner label panel 20' with the stop 70 abutting the vertical wall 12'. Notwithstanding the lower horizontal wall 68 and stop 70, the display portion, including the front and rear label panels 20' and 28' can still pivot in relation to the mounting portion, including the vertical wall 12', around the wall 18'. Thus, the lower horizontal wall 68 adds rigidity to the label holder by reducing the ability of the cantilevered rear and front label panels 20', 28' to pivot clockwise about the upper horizontal wall 18' past a preselected point.

Figure 8:
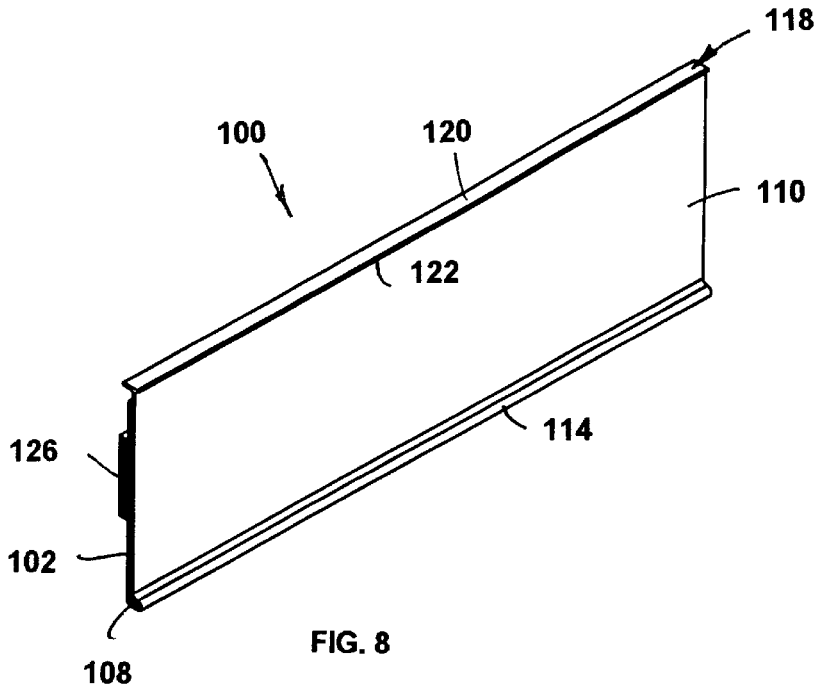
FIG. 8 is a perspective view of a third embodiment of a label holder which incorporates the features of the present invention therein.
Figure 9:
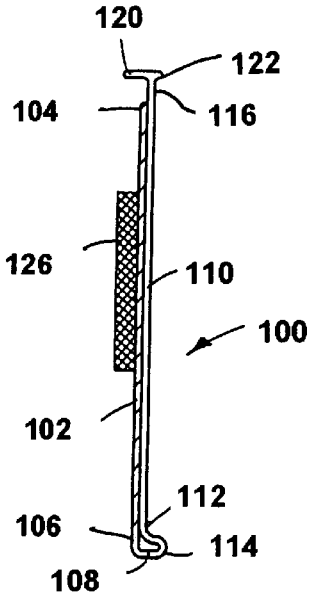
FIG. 9 is an enlarged side elevational view of the label holder of FIG. 8.

Referring now to FIG. 8, there is shown a label holder 100 in accordance with a third embodiment of the present invention. As best shown in FIG. 9, the label holder 100 includes a first or rear label panel 102 having a free upper end edge 104 and a lower end edge 106 joined to a horizontally extending bottom wall 108. A second or front label panel 110 extends parallel with the rear label panel 102. An arcuate lower end edge 112 of the front label panel 108 is joined to the bottom wall 108 and forms a spring-biased hinge 114 which urges the front label panel 110 into contact with the rear label panel 102. An upper end edge 116 of the front label panel 110 extends above the upper end edge 104 of the rear panel 102.

Figure 10:
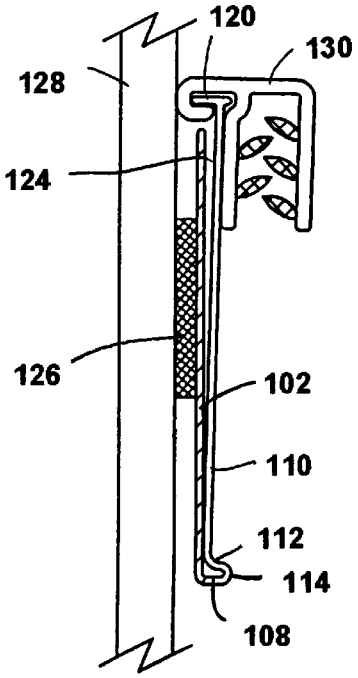
FIG. 10 is a side elevational view of the label holder of FIG. 9 mounted to a shelf, and a display card holder mounted to the label holder.

A top wall 118 extends transversely from the upper end edge 116 of the front label panel 110. The top wall 118 forms a dust flange 120 that extends rearward over the rear label panel 102. The top wall 118 also forms a heel portion 122 which extends slightly forward past the front label panel 110. As shown in FIG. 10, the rear and front label panels 102, 110 cooperate to define a label pocket 124 when the front label panel 110 is pivoted forwardly away from the rear label panel 102. The pocket 124 is adapted to receive a conventional planar merchandising label (not shown), or the like therein. An adhesive strip 126 is attached to an intermediate portion of the rear label panel 102 for securing the label holder 100 to an adjacent support surface. Thus, in the embodiment being described, a mounting portion including the adhesive strip 126 secures a display portion including the rear and front label panels 102, 110 and top wall 118 to a shelf, a wall, or the like.

Preferably, the rear label panel 102 is formed from an opaque thermoplastic material, and the front label panel 110 and top wall 118 are formed from a clear thermoplastic material. As with the label holder 10, the label holder 100 is preferably formed by a known co-extrusion process using different types of polyvinylchloride (PVC).

The label holder 100 may be secured to surfaces having different orientations. For example, as shown in FIG. 10, the adhesive strip 126 secures the label holder 100 a vertical surface 128 associated with a conventional merchandising display. When the label holder 100 is mounted to the display surface 128, the dust flange 120 prevents dust and other particles from settling in the pocket 124 and from settling on an upper end surface of a label positioned within the pocket 124. In addition, the dust flange 120, by virtue of being positioned above the upper edge 104 of the rear label panel 102, gives the user a convenient finger-accessible element which permits the user to easily pivot the front label panel 110 away from the rear label panel 102 to insert, reposition, modify, or replace a merchandising label from within the label pocket 124. Further, the dust flange 120 may be used to secure an optional display card holder 130 to the front label panel 108 and top wall 118 in the same manner as described above with regard to FIGS. 4–6.

Figure 11:
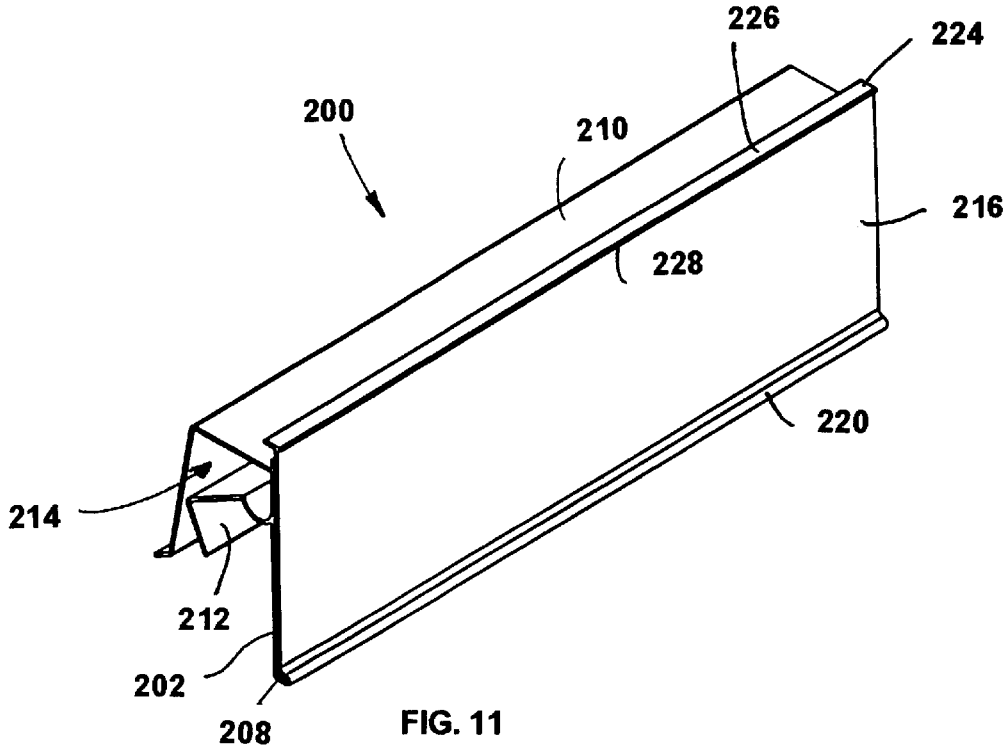
FIG. 11 is a perspective view of a fourth embodiment of a label holder which incorporates the features of the present invention therein.
Figure 12:
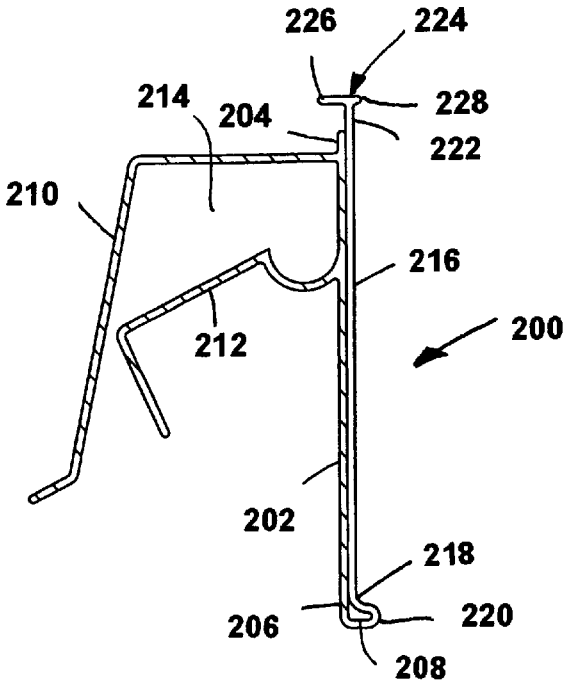
FIG. 12 is an enlarged side elevational view of the label holder of FIG. 11.

Referring now to FIGS. 11 and 12, there is shown a label holder 200 in accordance with a fourth embodiment of the present invention. The label holder 200 includes a display portion having a first or rear label panel 202 having a free upper end edge 204 and a lower end edge 206 joined to a horizontally extending bottom wall 208. A mounting portion of the label holder includes first angled arm 210 that extends from the rear label panel 202 near the upper end edge 204. A second angled arm 212 extends from an intermediate portion of the rear label panel 202. The first and second angled arms 210, 212 cooperate to define an "R-shaped" cavity 214 for receiving a conventional wire bar or rod (not shown) associated with known shelf or display rack systems. A second or front label panel 216 extends parallel with the rear label panel 202. An arcuate lower end edge 218 of the front label panel 216 is joined to the bottom wall 208 and forms a spring-biased hinge 220 which urges the front label panel 216 into contact with the rear label panel 202. An upper end edge 222 of the front label panel 216 extends above the upper end edge 204 of the rear panel 202.

A top wall 224 extends transversely from the upper end edge 222 of the front label panel 216. The top wall 224 forms a dust flange 226 that extends rearward over the rear label panel 202. The top wall 224 also forms a heel portion 228 which extends slightly forward past the front label panel 216. The rear and front label panels 202, 216 cooperate to define a label pocket (not shown) therebetween when the front label panel 216 is pivoted forwardly away from the rear label panel 202. The pocket is adapted to receive a conventional planar merchandising label (not shown), or the like therein. Thus, in the embodiment being described, a mounting portion including the first and second angled arms 210, 212 secure a display portion including the rear and front label panels 202, 216 and top wall 224 to a conventional wire merchandising fixture.

Preferably, the rear label panel 202 is formed from an opaque thermoplastic material, and the front label panel 216 and top wall 224 are formed from a clear thermoplastic material. As with the previous embodiments, the label holder 200 is preferably formed from a known co-extrusion process using different types of polyvinylchloride (PVC).

By flexing one or both angled arms 210, 212, the cavity 214 is enlarged so as to receive a wire bar therein. When the label holder 200 is mounted to the shelf, the dust flange 226 prevents dust and other particles from settling in the label pocket and from settling on an upper end surface of a label positioned within the label pocket. In addition, the dust flange 226, by virtue of being positioned above the upper edge 204 of the rear label panel 202, permits a user to easily pivot the front label panel 216 away from the rear label panel 202 to insert, reposition, modify, or replace a merchandising label from within the label pocket. Further, the dust flange 226 may be used to secure an optional display card holder (FIG. 3) to the front label panel 216 and top wall 224 in the same manner as described above with regard to FIGS. 4–6.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A label holder comprising:

a mounting portion wherein said mounting portion includes a vertical wall having an upper edge which engages a lip of a C-channel of an associated merchandising shelf;

a display portion joined to said mounting portion, said display portion including a rear label panel and a front label panel, said front label panel having a first edge and a second edge, said front label panel being joined to said rear label panel along said first edge; and a dust flange extending from said second edge in a direction toward said mounting portion, said dust flange extending over said rear label panel, wherein said dust flange includes a heel portion extending past a front surface of said front label panel and wherein said mounting portion, display portion and dust flange are of one piece.

2. The label holder of claim 1, wherein said vertical wall is joined to said rear label panel by a horizontal wall extending transversely between said vertical wall and said rear label panel.

3. The label holder of claim 2, further comprising a second horizontal wall spaced from said first horizontal wall and extending transversely between said vertical wall and said rear label panel.

4. The label holder of claim 1, wherein said rear label panel includes a first edge and a second edge, said rear label panel first edge being secured to said front label panel first edge and said rear label panel second edge being spaced from said front label panel second edge.

5. The label holder of claim 1, wherein said rear label panel and said front label panel cooperate to define a label pocket therebetween for receiving a merchandising label.

6. A label holder comprising:

a mounting portion;

a display portion connected to said mounting portion;

wherein said display portion comprises:

a first label panel having a first end edge and an opposing second end edge, a second label panel in registry with said first label panel and having a third end edge and an opposing fourth end edge, a hinge at which said first and said third end edges are joined together, and wherein said fourth end edge extends past said second end edge; and a dust flange extending from said fourth end edge over said second end edge in a direction toward said mounting portion wherein said dust flange further comprises a heel portion extending in a direction away from said mounting portion, wherein said mounting portion comprises a vertical wall having an upper edge and a lower edge which are adapted to engage with respective lips of a C-channel of an associated merchandising shelf and wherein an axis of said dust flange intersects said vertical wall of said mounting portion below said upper edge thereof.

7. The label holder of claim 6, wherein said mounting portion further includes:

a horizontal wall extending transversely between said vertical wall and said first label panel.

8. A merchandising system comprising:

a label holder comprising:

a mounting portion, a display portion connected to said mounting portion and including a rear panel having a lower edge and an upper edge, and a front panel having a lower edge and an upper edge, said rear panel lower edge being connected to said front panel lower edge, and a dust flange connected to said front panel upper edge and extending towards said mounting portion, said dust flange projecting above said rear panel upper edge; and, a display card holder selectively mounted on said dust flange, said display card holder including front and rear walls and fins mounted on at least one of said front and rear walls and extending towards another of said front and rear walls wherein said display card holder further comprises a contoured hook portion extending rearwardly away from said rear wall, said rear wall having an upper end which is indented in relation to a remainder of said rear wall, said rear wall indented portion forming a part of said contoured hook portion.

9. The merchandising system of claim 8, wherein said dust flange includes a heel portion extending past said second label panel, and said contoured hook portion engages with said dust flange and said heel portion.

10. The merchandising system of claim 8, wherein said front panel and said rear panel cooperate to define a label pocket therebetween for receiving a merchandising label.

11. The merchandising system of claim 8 wherein said mounting portion includes a vertical wall adapted to engage with a C-channel of an associated merchandising shelf.

12. The merchandising system of claim 11 wherein said vertical wall is joined to said rear label panel by a horizontal wall extending transversely between said vertical wall and said rear label panel.

13. The merchandising system of claim 12 further comprising a second horizontal wall spaced from said first horizontal wall and extending transversely between said vertical wall and said rear label panel.

14. The merchandising system of claim 11 wherein said mounting portion includes an adhesive strip secured to said rear label panel.

15. The merchandising system of claim 11 wherein said mounting portion includes a first angled arm extending from said rear label panel and a second angled arm spaced apart from said first angled arm and extending from said rear label panel, wherein said first and second angled arms cooperate to define an R-shaped cavity for receiving a wire rod of an associated merchandising shelf.

16. A merchandising system comprising:

a merchandising fixture having a support surface;

a label holder having a mounting portion for engaging with said support surface and a display portion of one piece with said mounting portion;

said display portion including a first label panel having a first edge and a second edge and a second label panel having a first edge and a second edge, said second label panel first edge being joined to said first label panel first edge;

a dust flange extending from said second label panel second edge over said first label panel second edge and toward said mounting portion, wherein said mounting portion comprises:

a vertical wall oriented approximately parallel to said first label panel, said vertical wall including an upper edge and a lower edge which each engage said support surface, and a first horizontal wall connecting said vertical wall to said first label panel; and, a display card holder selectively mounted on said dust flange.

17. The merchandising system of claim 16 further comprising a second horizontal wall extending rearwardly from said first label panel towards said vertical wall of said mounting portion, said second horizontal wall being spaced from said first horizontal wall.

18. The merchandising system of claim 16 further comprising a display card holder selectively mounted on said second label panel.

* * * * *